US006273551B1

(12) United States Patent
Guerin et al.

(10) Patent No.: US 6,273,551 B1
(45) Date of Patent: Aug. 14, 2001

(54) ACOUSTIC INK PRINTING INTEGRATED PIXEL OSCILLATOR

(75) Inventors: Jean-Michel Guerin, Glendale; Eugene Wilson, Culver City, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/140,530

(22) Filed: Aug. 27, 1998

(51) Int. Cl.[7] ..... B41J 2/135
(52) U.S. Cl. ..... 347/46
(58) Field of Search ..... 347/10, 11, 46; 426/600

(56) References Cited

U.S. PATENT DOCUMENTS 5,541,628 * 7/1996 Chang et al. ..... 347/10
5,790,139 * 8/1998 Umeno et al. ..... 347/10
5,798,770 * 8/1998 Nakayasu et al. ..... 347/46

* cited by examiner

*Primary Examiner*—John Barlow
*Assistant Examiner*—Michael S Brooke
(74) *Attorney, Agent, or Firm*—Philip T. Virga

(57) ABSTRACT

An acoustic inkjet print head with a plurality of transducers for generating acoustic waves utilizes an individual control circuit for each transducer. The transducers are responsive to their respective control circuit to oscillate at a resonance frequency, which is defined by the respective transducer, its control circuit and the glass substrate.

3 Claims, 5 Drawing Sheets

ACOUSTIC INK PRINTING INTEGRATED PIXEL OSCILLATOR

BACKGROUND OF THE INVENTION

This application is related to acoustic inkjet printing and more particularly to an acoustic inkjet print head with individual control circuits for the piezo-electric transducer of each aperture to provide an acoustic wave with single optimized frequency.

Referring to FIG. 1, there is shown a portion of a prior art acoustic inkjet print head 10. Print head 10 has a housing 12, which contains a sheet of glass substrate 14 and ink 16 over the glass substrate 14. Housing 12, has a plurality of apertures 18, each of which is dedicated to a pixel. Under the glass substrate, there is a plurality of piezo-electric transducers 20. For the purpose of simplicity, hereinafter, the "piezo-electric transducer" is referred to as "transducer". Each transducer 20 is dedicated to one aperture 18 and is located directly across its respective aperture 18. Once each transducer 20 is activated, it will oscillate and generate acoustic waves 22. The acoustic waves 22 travel within the glass substrate 14 toward the ink 16.

Over the glass substrate 14, there is a plurality of Fresnel lenses 24, each of which corresponds to one of the transducers 20 and is located across from its respective transducer 20. The Fresnel lenses 24 receive the acoustic waves 22 from the transducers 20 and focus the acoustic waves onto their respective aperture 18. The focused waves 22 cause the ink to be ejected from the apertures.

Transducers 20 receive an RF frequency signal from an oscillator 30. Oscillator 30 generates an RF signal and sends it to an RF Amplifier 32 to be amplified. The amplified RF signal is sent to several RF power splitters 34. Each output of power splitters 34 is distributed between the plurality of transducers 20.

The output of each power splitter 34 is connected to a set of transducers 20 through individual switches $S_1$ for providing RF signal to respective transducers 20. Switches Sare controlled by pixel information. Based on the pixel information, when a given pixel needs ink, switch $S_1$ of a respective transducer closes to send the RF signal to that transducer for activating the transducer and causing ink to be ejected from the respective aperture 18.

In operation, the acoustic waves 22, which are focused onto the apertures 18 will partially be reflected by the surface 50. The reflected waves interfere with the original waves 22. If the impedance of either the ink 16 or Fresnel lens 24 does not match that of the glass substrate 14, the resulting stack of glass substrate 14, Fresnel lens 24, and the ink 16 will operate as a cavity. Hereinafter the combination of cavity (glass substrate 14, Fresnel lens 24 and the ink 14) and transducer will be referred to as resonant stack. Depending on the frequency of the original waves and the cavity length, the reflected waves can have a different phase than the phase of the original waves.

Referring to FIG. 2, there is shown the resonance distribution of a resonant stack. FIG. 2, shows the effect of the interference between the original acoustic waves and the reflecting acoustic waves. Referring to both FIGS. 1 and 2, if the reflected waves in the glass substrate 14 have opposite phase as that of original waves, then they will cancel the original waves 22 (cancellation C). However, if the reflected waves have the same phase as that of the original waves 22, they will increase the amplitude of the original waves (spikes S). Any phase between the two extremes of in-phase or the opposite-phase will interfere constructively or destructively with the original waves depending on if the phase is closer to in-phase or to the opposite phase respectively.

In this approach, an external frequency from the oscillator 30 is applied to each transducer 20 to cause the transducer to oscillate. Typically in the absence of an external frequency, if each transducer 20 starts oscillating, it will oscillate at a resonance frequency which is defined by the resonant stack. Usually, the external frequency does not match the resonance frequency of the resonant stack and as a result, the transducers 20 generate acoustic waves which do not resonate with the resonant stack. In addition, manufacturing tolerances cause each resonant stack to oscillate at a unique frequency.

Since the transducers oscillate at different frequencies than the resonance frequencies of the resonant stack, spikes or cancellation can occur. As can be observed, the spikes S occupy a small percentage such as 5% of the distribution and the majority of distribution is cancellation. This reduces the efficiency of the transducers. In addition, depending on the acoustic waves generated by the transducers 20, the intensity of the acoustic waves will vary strongly.

This problem is usually resolved in two ways. One approach is to deposit a matching layer over the glass substrate 14. This layer compensates for the mismatched impedance of the ink 16, the Fresnel lenses 24 and the glass substrate 14 and causes a reduction of amplitude of the reflected waves. Therefore, the reflected waves do not interfere as strongly with the original waves.

Another approach is to sweep or chirp the RF frequency to vary the frequency of the transducer's oscillation in order to generate acoustic waves with variable frequencies. Varying the frequency within a range gradually from one end of the range to the other end of the range is called "sweeping" or "chirping". By chirping the frequency, the resulting waves will have the effect of the average of all the waves with different frequencies and therefore average out the resonance spike problem.

This configuration has several problems. The inefficiency of the transducers causes the control circuit 36 to dissipates a great amount of RF energy. The control circuit 36 has to be fully on regardless of the number of active transducers. In addition, the external frequency applied to the transducers has to be chirped, which in turn causes the acoustic waves generated at the transducer to have a varying frequency. With a varying frequency, at any given time, the reflected waves will have a different phase. Therefore, due to the varying phase of the reflected waves, the waves reaching each aperture will have an average frequency and amplitude.

It is an object of this invention to eliminate the high power dissipation. Also, it is another object of this invention to individually control and adjust each transducer to maximize the intensity of the acoustic waves when they reach their respective apertures and reduce the net amount of RF power required to eject a drop.

SUMMARY OF THE INVENTION

According to the present invention, an acoustic inkjet print head is disclosed which comprises a sheet of glass substrate, a plurality of transducers located on the glass substrate, and a plurality of control circuits each of which corresponds to one of the plurality of transducers. Each one of the of control circuits is electrically connected to a respective transducer. Each one of the transducers is responsive to a respective control circuit to oscillate at a resonance frequency which is defined by the respective transducer and the glass substrate.

DESCRIPTION OF THE PREFERRED EMBODIMENT

Figure 3:
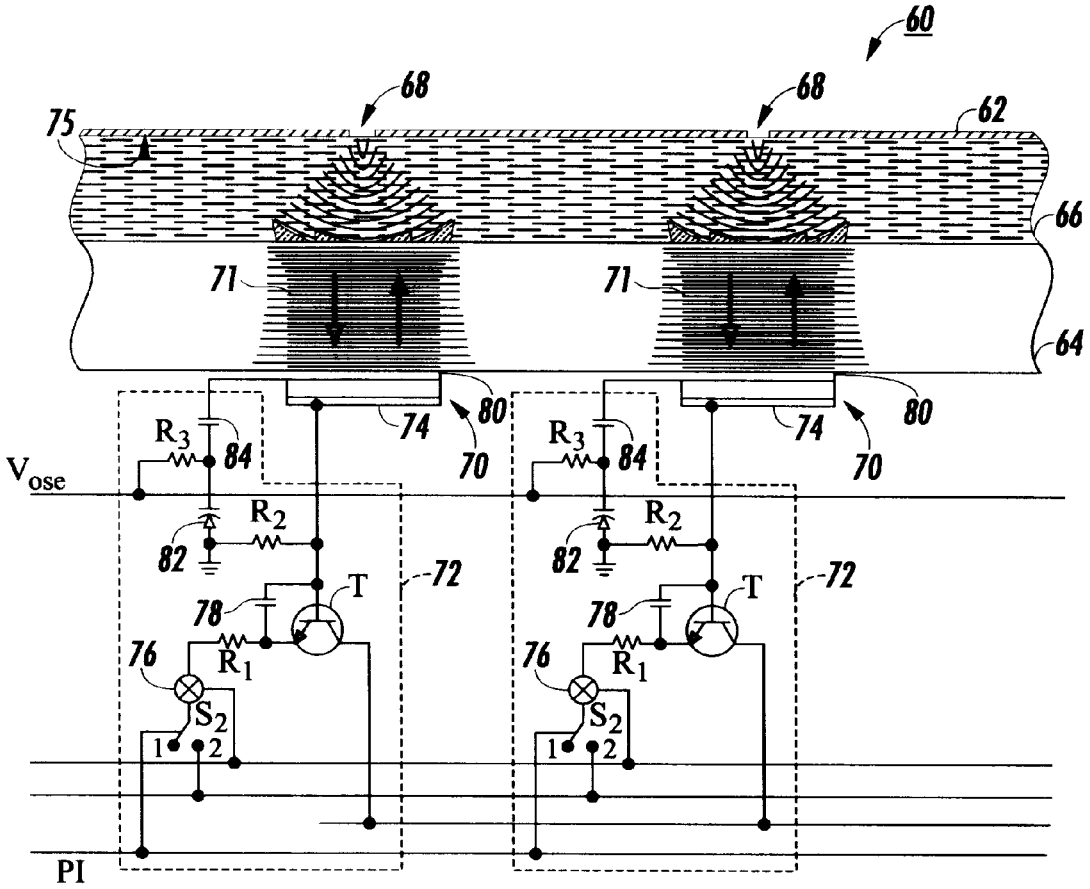
FIG. 3 shows an acoustic inkjet print head of this invention.

Referring to FIG. 3, there is shown an acoustic inkjet print head 60 of this invention. The print head 60 has a housing 62 which includes a sheet of glass substrate 64, ink 66 over the glass substrate 64 and a plurality of apertures 68. There is a plurality of piezo-electric transducers 70 each of which corresponds to an aperture 68. Each one of the transducers 70 is located directly across from its respective aperture 68.

In contrast to the prior art, in this invention, each transducer 70 acts as an individual oscillator with a resonance frequency defined by the combination of the transducer 70, its control circuit 72, the glass substrate 64, the Fresnel lens 73, and the ink 66. However, the glass substrate 64, the Fresnel lens 73 and the ink 66 still act as a cavity. It should be noted that in this invention, the matching layer of prior art is removed to increase the Q of the cavity.

Each transducer 70 is connected to an individual control circuit 72. One plate 74 of each transducer 70 is connected to a base of an NPN transistor T. The collector of the transistor T is connected to +V voltage and its emitter is connected to an adder 76 through a resistor $R_1$. One of the inputs of the adder 76 is connected to $-V_1$ voltage and its second input is connected to $-V_2$ voltage through switch $S_2$. In response to pixel information PI switch $S_2$ switches voltage $V_2$ on and off. $V_1$ is in the range of 0.5–1V and $V_2$ is in the range of 1–3V. The emitter of the transistor T is connected to its base through a capacitor 78. The base of the transistor T is grounded through resistor $R_2$. Plate 80 of the transducer 70 is connected to the cathode of a tuning diode 82 through a capacitor 84. The cathode of the tuning diode 82 is also connected to a voltage $V_{OSC}$ through a resistor R3. The anode of the tuning diode is grounded.

In operation, to turn on transducers 70, switch $S_2$ will be positioned to turn off $-V_2$ voltage. Therefore, the adder 76 will send only $-V_1$ to the emitter of transistor T. It should be noted that for the purpose of discussion, only $-V_1$ is sent to the emitter of transistor T. However if one desires both voltages $-V_1$ and $-V_2$ can be sent to the emitter of transistor T to turn on the transducers 70. Once the +V and $-V_1$ power lines are turned on, the transducer 70 will start oscillating. However, the oscillation of the transducer will fade away if no alternative (AC) signal is applied to the transducer 70.

Figure 1:
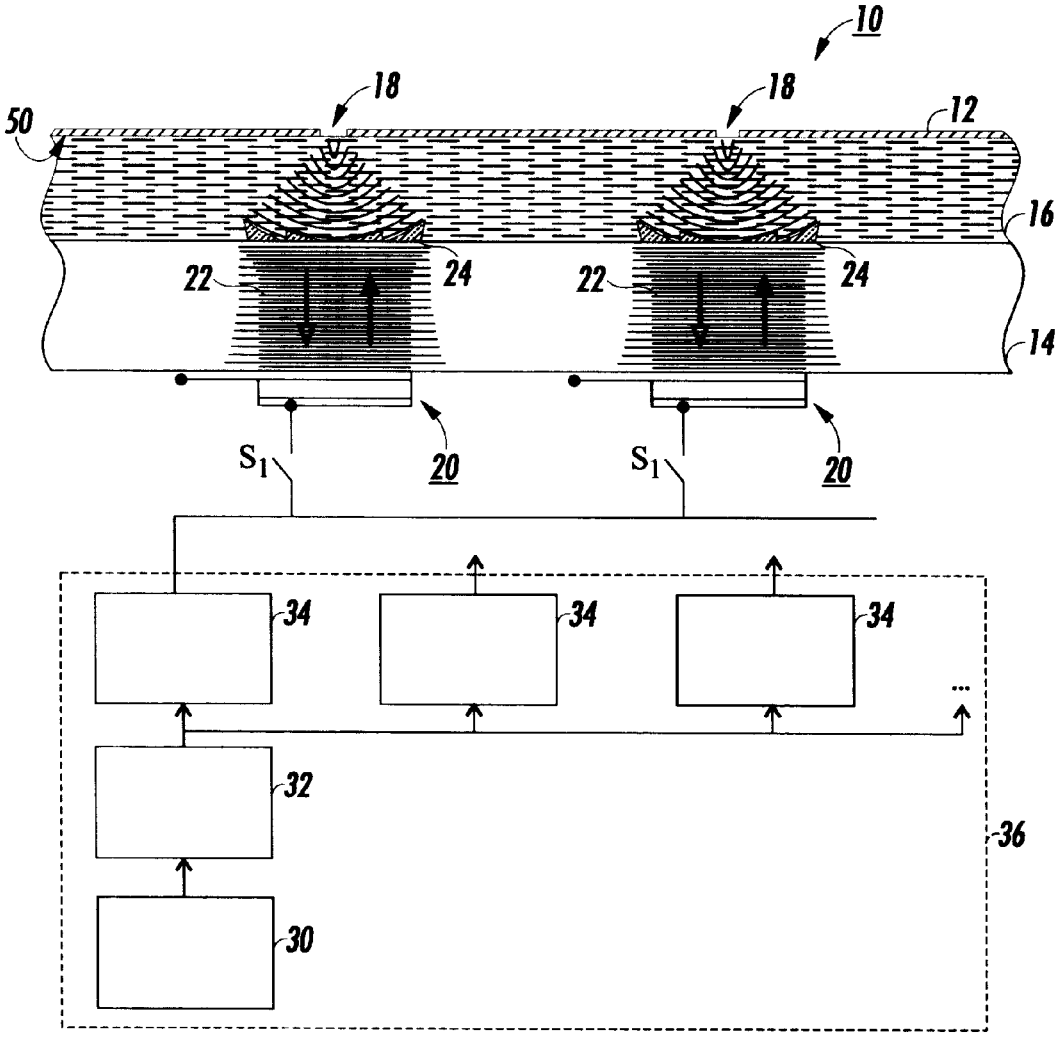
FIG. 1 Prior Art
FIG. 1 shows a prior art acoustic inkjet print head.
Figure 2:
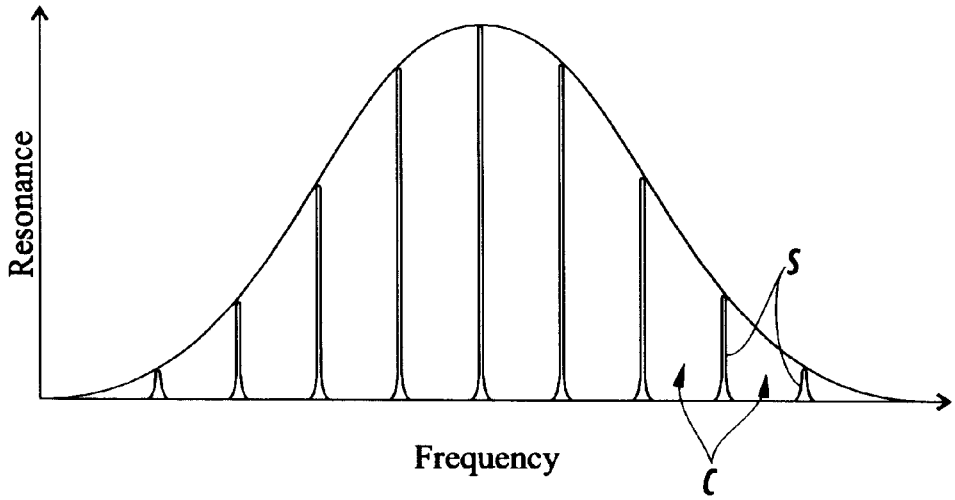
FIG. 2 shows the resonance distribution of a cavity.

Transducers 70 not only generate acoustic waves 71, they also generate AC signal on the base of their respective transistor T. The AC signal on the base of the transistor T is amplified by the transistor T and is directed onto its emitter. The amplified signal is fed back to the base of the transistor T by capacitor 78. Since the amplified AC signal has the same phase as the AC signal of the base, the feedback signal causes the AC signal of the base to stay at a certain level and prevent the AC signal of the base from fading away. Keeping the AC signal of the base at a certain level causes the transducer to continuously oscillate. This in turn will eliminate the need for a separate oscillator, such as oscillator 30 of FIG. 1, to activate the transducers 70.

Placing switch $S_2$ at position 1 disconnects $-V_2$ voltage from the adder 76 and therefore the adder 76 sends $-V_1$ voltage to emitter of transistor T. This will keep the transducer 70 at a humming level. Humming level is a level which keeps the transducer 70 at oscillation mode. However, at humming level the amplitude of the acoustic waves 71 generated by the transducer 70 are not high enough to eject ink.

When ejection is required, switch $S_2$ will be switched to position 2, which connects $-V_2$ voltage to adder 76. Then, adder 76 adds the two voltages $-V_1$ and $-V_2$ and sends the result to emitter of transistor T. This causes the amplitude of the acoustic waves 71 generated by the transducer 70 to increase. The increased amplitude will cause the acoustic waves 71 to have enough power to eject ink. Keeping the transducers at humming level and adding $-V_2$ voltage at the ejection time, reduces the response time (rise and fall times of the waves 71) of ejecting ink.

To further optimize the power of the acoustic waves, their frequencies need to be adjusted. Each transducer in combination with its respective control circuit 72, the glass substrate 64, the respective Fresnel lens 63 and the ink 66 operate as a single unit, which hereinafter is referred to as "resonance system". The initial frequency of each transducer is defined by the transducer and its control circuit.

Figure 4:
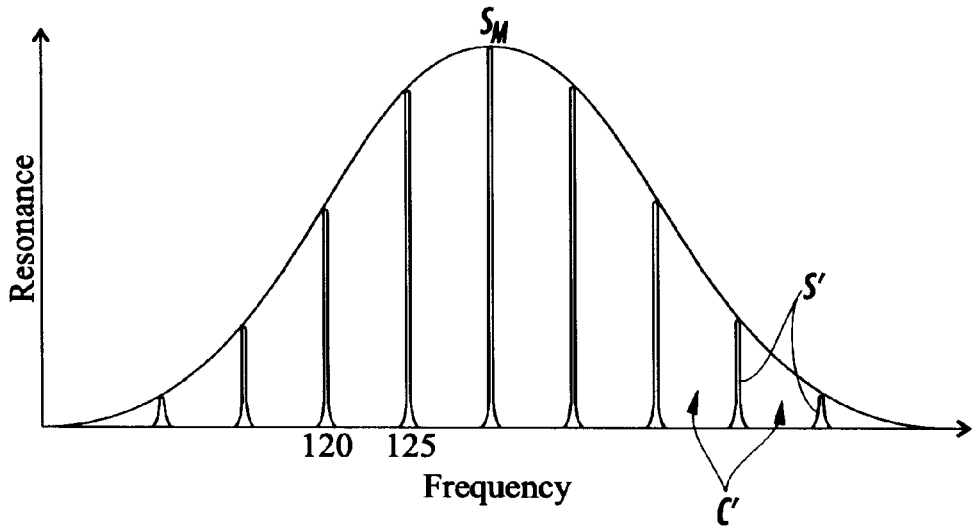
FIG. 4 shows the resonance distribution of a cavity of the print head of FIG. 3.

The cavity corresponding to each transducer has a resonance distribution as shown in FIG. 4. The resonance distribution shows the effect of different frequencies of acoustic waves within the resonance system. Depending on the frequency of the acoustic waves, the reflected waves will either cause spikes S' when they are in phase with the original waves or cause cancellation C' when they are at the opposite phase of the original waves.

Referring to both FIGS. 3 and 4, initially when each transducer 70 starts generating acoustic waves, there are no reflecting waves. At this stage, each transducer starts with its initial frequency. Once the acoustic waves reach the surface 75, they will be reflected back. The reflected acoustic waves not only interfere with the original waves, they also have an impact on the transducers 70 and cause the frequency of the resonance system to gravitate toward the frequency of the closest spike (resonance frequency). For example, if a transducer starts with 124 MHz, after the acoustic waves are reflected back, the frequency of the resonance system will change to 125 MHz, which is the frequency of the closest spike.

Typically, it is desirable to have acoustic waves with the frequency of the strongest spike $S_M$ (maximum amplitude). However, depending on the tolerances of the resonance systems, each transducer starts at a different frequency. Therefore, there is a need to adjust the total capacitance of each resonance system to adjust its frequency to the desirable frequency of the strongest spike for that resonance system.

In FIG. 3, the frequency of the oscillation (resonance frequency) of the resonance system can be adjusted through the tuning diodes 82. By adjusting $V_{osc}$, which is a voltage generated by a test/tuning station, the capacitance of the tuning diodes 82 can be modified which in turn modifies the total capacitance of each resonance system. This changes the resonance frequency of the transducers. Adjusting the voltage level of $V_{OSC}$ provides maximum power on the acoustic waves of the transducers of a print head.

Figure 5:
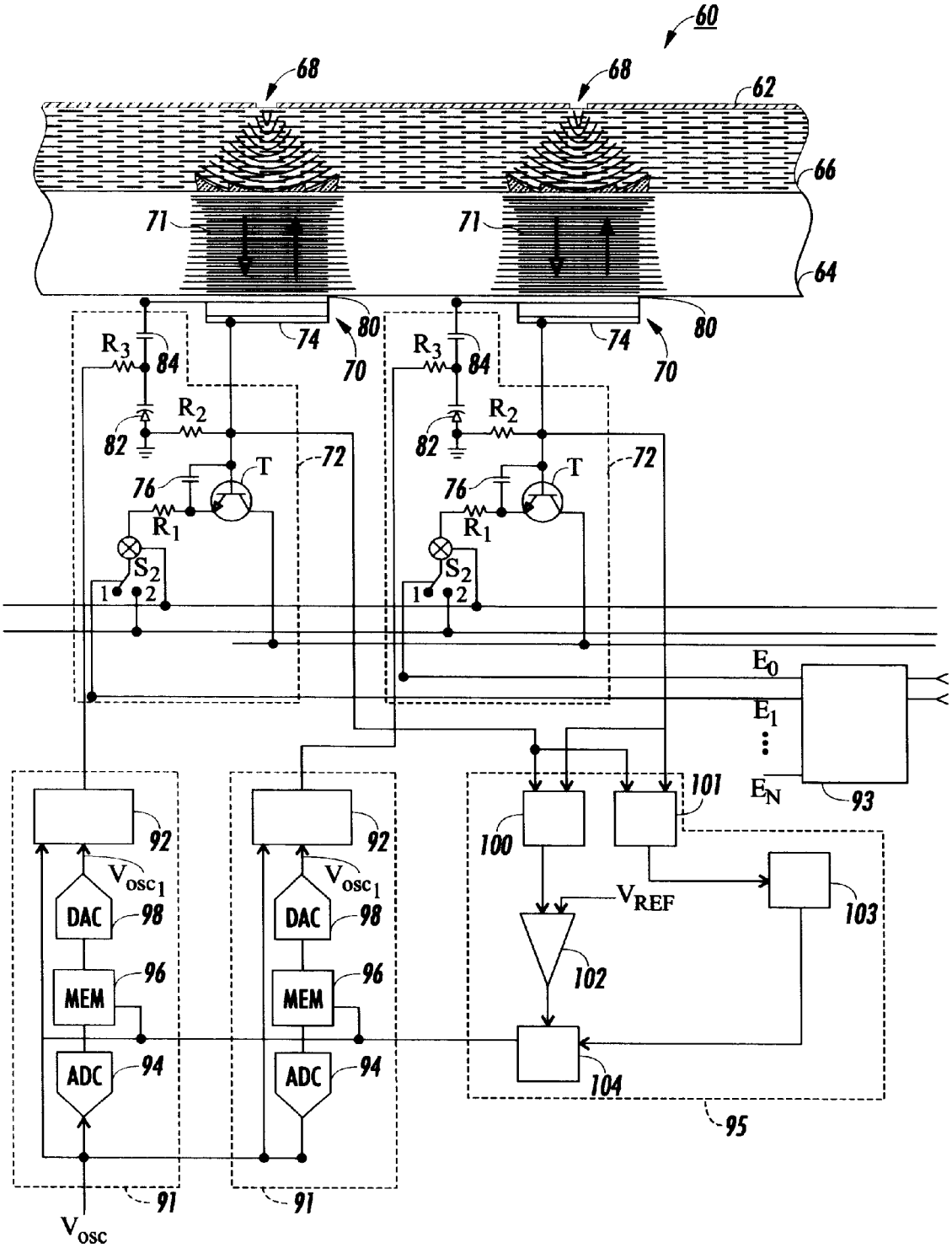
FIG. 5 shows the preferred embodiment of the acoustic inkjet print head of this invention.

However, referring to FIG. 5, there is shown the preferred embodiment 90 of this invention. In FIG. 5, all the elements that have the same function and purpose as the elements of 3, are given the same numeral references. In the embodiment of FIG. 5, the tuning diode of each transducer receives an individual voltage to individually adjust the resonance frequency of each transducer.

In this approach, block 91 is added to each control circuit 72 to individually adjust the tuning diode 82 of its respective transducer 70. In block 91, the $V_{OSC}$ is connected to the multiplexer 92. Each Multiplexer 92 is connected to one of the outputs $E_0$–$E_N$ of the data distributor 93. Distributor 93 has one output per each multiplexer 92. For calibration purpose, at any given time, the data distributor 93 selects only one of the multiplexers 92 to adjust the respective tuning diode 82 of a respective transducer 70.

In each block 91, $V_{OSC}$ is also connected to an analog to digital converter (ADC) 94. The output of the ADC 94 is connected to a memory 96, the output of the memory 96 is connected to a digital to analog converter (DAC) 98 and the output of the DAC 98 is connected to the multiplexer 92 as $V_{OSC1}$.

Calibration block 95 is connected to all the control blocks 72 and blocks 91. The base of the transistor T is connected to the RF detector 100 and the frequency monitor 101 of the calibration block 95. The RF detector 100 measures the amplitude of the spikes of the acoustic waves through the AC signal generated by the transducers 70. The output of the RF detector 100 is connected to a comparator 102 which also receives a reference voltage $V_{REF}$. $V_{REF}$ is an acceptable voltage level for the AC signal from the transducer 70. Comparator 102 compares the output of the RF detector 100 to $V_{REP}$ and if $V_{REF}$ is higher, the acoustic waves are not in the spike region. In this case it sends a "0" to the latch 104. However, if the output of the RF detector 100 is higher than $V_{REF}$, the acoustic waves are in the spike region and therefore it sends a "1" to the latch 104.

The frequency monitor 101 measures the frequency of the spikes of the acoustic waves through the AC signal generated by the transducers 70. The output of the frequency monitor 101 is connected to a processor 103. The processor compares the output of the frequency monitor to a narrow range N of frequencies. Range N is the expected range for the frequency of the maximum strength spike. Processor 103 compares the output of the frequency monitor 101 to range N and if it falls within range N, the acoustic waves are in the maximum strength spike region and therefore the processor 103 sends a "1" to the latch 104. However, if the output of the frequency monitor 101 falls outside of range N, the acoustic waves are not in the maximum strength spike region and therefore the processor 103 sends a "0" to the latch 104.

In operation, to calibrate each transducer 70 through its tuning diode 82, one of the $E_0$–$E_N$ will enable a respective multiplexer 92. Once enabled, the multiplexer 92 enters the calibration mode in which it automatically selects the $V_{OSC}$ input and sends it to the tuning diode 82. $V_{OSC}$ is a ramping voltage from 0–15 volts. As the $V_{OSC}$ increases, the voltage of the AC signal (output voltage) generated by the transducer 70 and measured by the RF detector 100 also increases.

As long as one or both output voltages of the comparator 102 and processor 103 is/are "0", the latch 104 is inactive and the increasing $V_{OSC}$ is stored in the memory 96. Once the latch 104 receives "1" from both comparator 102 and processor 103, it latches the memory 96 to its current value. When both comparator 102 and the processor 103 send out "1", it means, the frequency is at the maximum strength spike region. Therefore, the latch stores this value of the $V_{OSC}$ at the memory 96.

Once the multiplexer 92 is disabled, it exits the calibration mode and selects the $V_{OSC1}$ which is the value of memory 96 which will be applied to the tuning diode 82 during the normal operation of the acoustic inkjet print head 90.

It should be noted that in both embodiments of FIGS. 3 and 5, the control circuit is fabricated on a separate chip than the chip of the print head. Then, the two chips are attached to each other through flip chip bonding.

This circuit 72 has multiple advantages over the prior art circuit 36. In FIGS. 3 and 5, since each transducer 70 has an individual control circuit 72, a large power supply is not required to activate all the transducers. Instead, each individual control circuit 72 requires much less power compared to the control circuit 36 of the prior art. In addition, chirping is eliminated since each transducer generates waves with single frequency and maximum power.

It should be noted that numerous changes in details of construction and the combination and arrangement of elements may be resorted to without departing from the true spirit and scope of the invention as hereinafter claimed.

What is claimed is:

1. An acoustic inkjet print head comprising:

a housing having a plurality of apertures;

a sheet of glass substrate having a first and a second opposing surfaces;

said sheet of glass substrate being located within said housing;

said housing having ink between said first surface of said glass substrate and said plurality of apertures;

a plurality of transducers for generating acoustic waves;

said plurality of transducers being located on said second surface of said sheet of glass substrate and each corresponding to one of said plurality of apertures;

a plurality of fresnel lenses being located on said first surface of said sheet of glass substrate and each corresponding to one of said plurality of apertures and a respective one of said plurality of transducers;

each one of said plurality of fresnel lenses focusing said acoustic waves of a respective one of said plurality of transducers through ink onto a respective one of said plurality of apertures;

a plurality of control circuits each of which corresponding to one of said plurality of transducers;

each one of said plurality of control circuits being electrically connected to a respective one of said plurality of transducers;

each one of said plurality of transducers being so constructed and arranged to be responsive to a respective one of said plurality of control circuits to oscillate at a resonance frequency defined by said respective transducer, said respective control circuit, said glass substrate, said fresnel lens, and said ink, wherein each of said plurality of control circuits has a feedback circuit to receive the resonance frequency and feed it back to said respective transducer.

2. The acoustic inkjet print head recited in claim 1, wherein said plurality of control circuits are connected to an adjustment circuit to adjust the resonance frequency of said plurality of said transducers and said glass substrate.

3. The acoustic inkjet print head recited in claim 1, wherein each of said control circuits has an adjustment circuit to adjust the resonance frequency of said respective transducer and said glass substrate.

* * * * *